US007568245B2

(12) United States Patent
Milam

(10) Patent No.: US 7,568,245 B2
(45) Date of Patent: Aug. 4, 2009

(54) "T"-SHAPED SLEEPING BAG

(76) Inventor: Michael Milam, 13550 Washington St., #6A, Thornton, CO (US) 80241

( * ) Notice: Subject to any disclaimer, the term of this patent is extended or adjusted under 35 U.S.C. 154(b) by 0 days.

(21) Appl. No.: 11/977,600

(22) Filed: Oct. 25, 2007

(65) Prior Publication Data

US 2008/0098522 A1 May 1, 2008

Related U.S. Application Data

(60) Provisional application No. 60/854,370, filed on Oct. 25, 2006.

(51) Int. Cl.
*A47G 9/08* (2006.01)

(52) U.S. Cl. ..... 5/413 R; D2/719

(58) Field of Classification Search ..... 5/413 R, 5/413 AM, 482; 2/69, 69.5; D2/719, 718
See application file for complete search history.

(56) References Cited

U.S. PATENT DOCUMENTS

D120,718 S * 5/1940 Friedman ..... D2/719
2,971,205 A * 2/1961 Shultz ..... 5/413 R
4,972,533 A * 11/1990 Brown ..... 5/413 R
D346,688 S * 5/1994 Hill ..... D2/719
5,321,863 A * 6/1994 Yamaguchi et al. ..... 5/655
7,395,562 B2 * 7/2008 Ricketts ..... 5/413 R

* cited by examiner

*Primary Examiner*—Alexander Grosz
(74) *Attorney, Agent, or Firm*—Ruth Eure

(57) ABSTRACT

The present invention provides a sleeping bag with additional material at the bottom of the head end, forming a "T"-shaped sleeping bag. The additional material forms the cross of the "T" and provides a greater surface area on which to sleep. This modification allows for more comfort in a wider variety of positions than has been available with standard prior art sleeping bags. The cross of the "T"-shape can accommodate a pillow, if desired, and gives added protection and coverage to the head and shoulders of the user. The cross of the "T" can be removably attached to the main body of the sleeping bag, or can be an integral part of the sleeping bag.

6 Claims, 2 Drawing Sheets

"T"-SHAPED SLEEPING BAG

CLAIM OF PRIORITY

This patent application claims priority from U.S. Provisional Patent Application 60/854,370, filed Oct. 25, 2006.

FIELD OF THE INVENTION

This invention pertains to the field of sleeping bags.

BACKGROUND OF THE INVENTION

Standard, rectangular sleeping bags have been in existence for many years. The standard sleeping bag offers little comfort to the restless sleeper, and provides no room for movement of the arms or upper torso of the user. If a sleeper tries to turn over in a regular sleeping bag he or she may find that his or her arms are exposed to the elements. Several attempts to modify the design of sleeping bags have been put forth by the prior art.

U.S. Pat. No. 4,033,001 describes a sleeping bag which has an upper section which comprises a hood and sleeves, and a lower section for the lower body.

U.S. Pat. No. 6,968,582 is directed to a comforter or blanket with gussets to expand at the head-end.

Nowhere in the prior is found a modified sleeping bag which provides the user with the comfort and protection of the arms and upper body as is found in the instant invention.

SUMMARY OF THE INVENTION

The purpose of the sleeping bag of the present invention is to provide greater protection and comfort in a wider variety of sleeping positions than can be achieved by the use of a conventional rectangular sleeping bag.

The present invention provides a sleeping bag with additional material at the bottom of the head end, forming a "T"-shaped sleeping bag. The additional material forms the cross of the "T" and provides a greater surface area on which to sleep. This modification allows for more comfort in a wider variety of positions than has been available with standard prior art sleeping bags.

In an embodiment, the cross of the "T"-shape can accommodate a pillow, if desired, and gives added protection and coverage to the head and shoulders of the user. The sleeping bag of the present invention does not require an underlying pad to accomplish this goal.

In use, a person can sleep with his or her torso in the main rectangular portion of the sleeping bag, either on the back or the stomach, and have their arms in any conceivable position or arrangement either inside or outside of the bag and still have comfort and protection provided by the cross of the "T" portion of the bag. The sleeping bag of the present invention can be used in any temperature or climate that the bag is rated for according to the standard rating system.

It is an object of the present invention to provide a sleeping bag with an improved design having additional material to accommodate the upper torso, arms and head of the user.

It is an additional object of the present invention to provide a sleeping bag with an improved design having additional material to accommodate the upper torso, arms and head of the user, having additional material removably attached to the main portion of the sleeping bag.

It is a still further object of the present invention to provide a sleeping bag with an improved design having additional material to accommodate the upper torso, arms and head of the user, having the additional material removably attached using a zipper.

It is a still further object of the present invention to provide a sleeping bag with an improved design having additional material to accommodate the upper torso, arms and head of the user, having the additional material removably attached using hook and loop fastener.

It is a still further object of the present invention to provide a sleeping bag with an improved design having additional material to accommodate the upper torso, arms and head of the user, having the additional material removably attached using snaps.

It is a still further object of the present invention to provide a sleeping bag with an improved design having additional material to accommodate the upper torso, arms and head of the user, having the additional material removably attached using buttons.

It is a still further object of the present invention to provide a sleeping bag with an improved design having additional material to accommodate the upper torso, arms and head of the user, having the additional material as an integral part of and not removably attached to the main portion of the sleeping bag.

It is a still further object of the present invention to provide a sleeping bag with an improved design having additional material to accommodate the upper torso, arms and head of the user, having the additional material fixedly attached using stitching where material of cross of T is different material than main body of the sleeping bag It is a still further object of the present invention to provide a sleeping bag with an improved design having additional material to accommodate the upper torso, arms and head of the user, having the additional material fixedly attached using stitching where material of cross of T is the same material as main body of the sleeping bag.

DETAILED DESCRIPTION OF THE INVENTION

Figure 1:
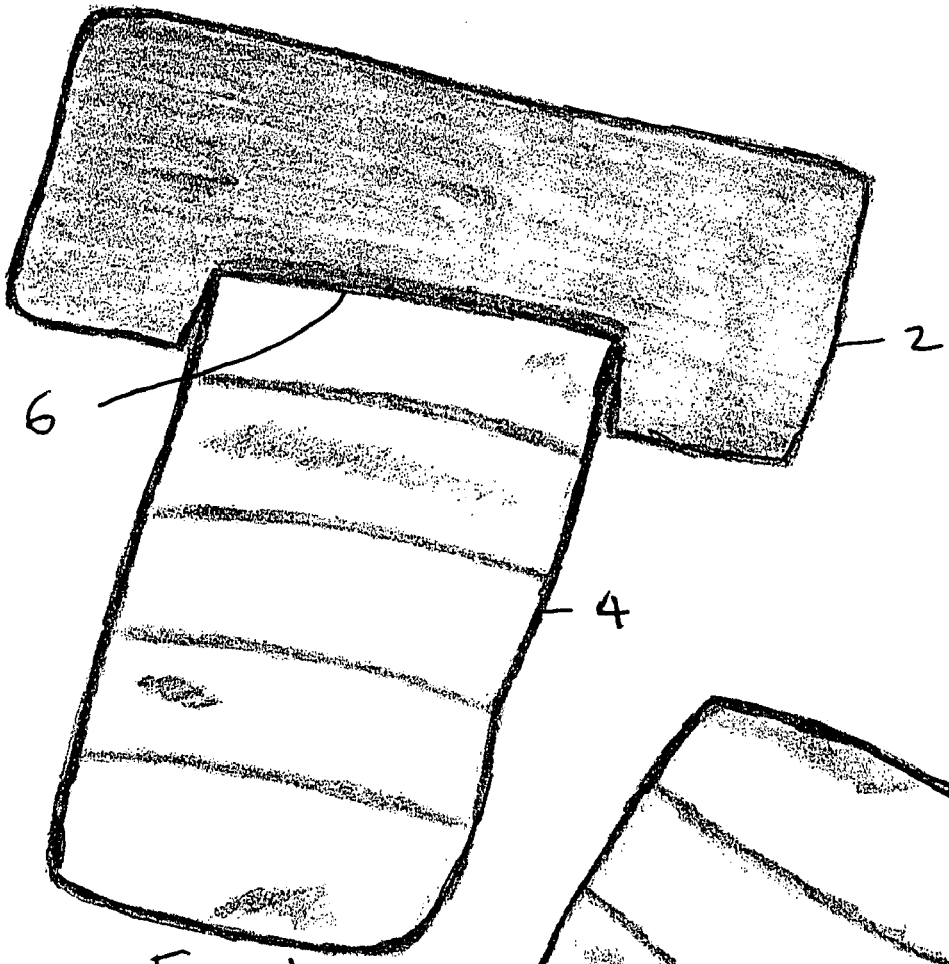
FIG. 1 is a top view of the sleeping bag of the present invention, showing the bag in a closed position with the cross of the "T" being a different material than the main body of the sleeping bag.
Figure 2:
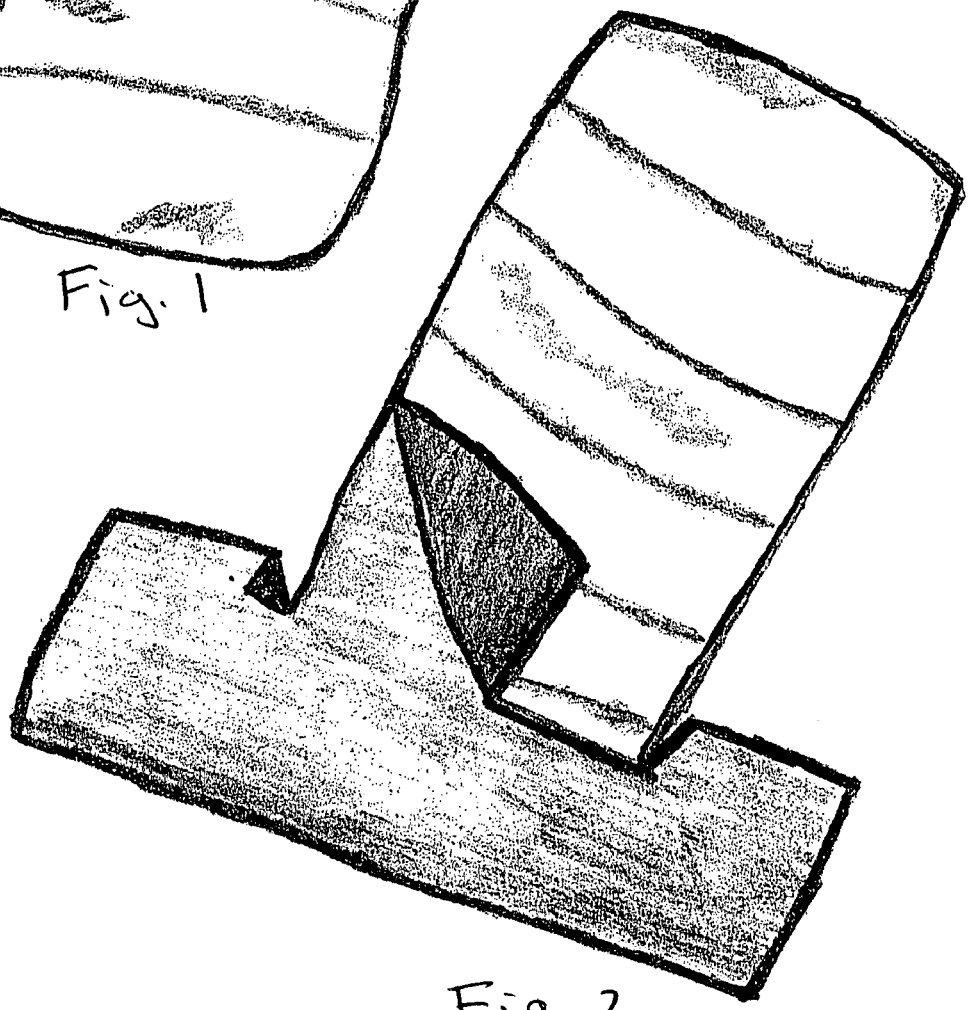
FIG. 2 is a top view of the sleeping bag of the present invention, shown the bag in a partially unzipped position.
Figure 3:
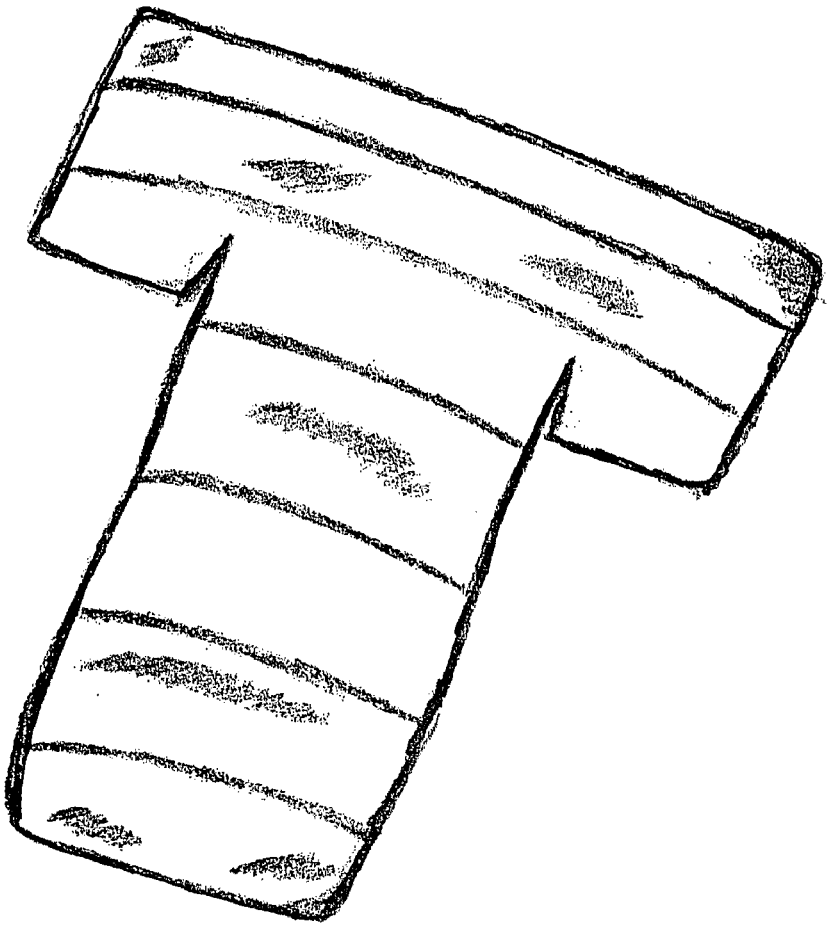
FIG. 3 is a bottom view of the sleeping bag of the present invention, with the cross of the "T" being the same material as the main body of the sleeping bag.
Figure 4:
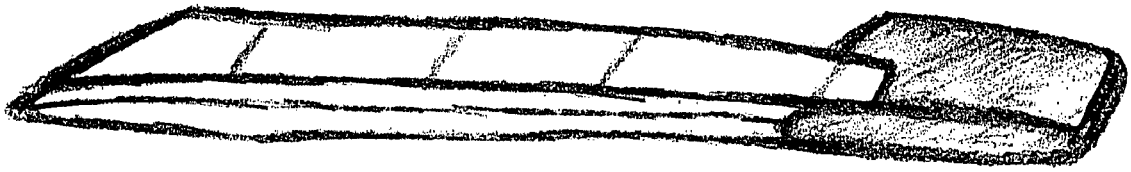
FIG. 4 is a side view of the sleeping bag of the present invention showing the bag with the cross of the "T" being a different material than the main body of the sleeping bag.

The present invention provides a modified design to a sleeping bag to provide more surface area for the sleeper to sleep on. This modification allows for more comfort in a wider variety of positions than has been available with standard prior art sleeping bags.

The cross of the "T" is part of the bottom of the sleeping bag to provide more surface area for the sleeper to sleep on. The cross of the "T" can be designed for new sleeping bags.

In an alternative embodiment, the material can be equipped with appropriate fasteners to fit onto a pre-existing bag and retrofit a sleeper's favorite bag with the additional material to form the cross of the "T".

In a further alternative embodiment, the bag is constructed with a one piece construction to prevent the ingress of moisture, vermin or foreign material into the sleeping area.

In an embodiment where the cross of the "T" 2 is attached to the main body of the sleeping bag 4, the place of attachment 6 is at the end of the bag, however, the body of the "T" 2 overlaps the main body of the sleeping bag 4 significantly to minimize the ingress of moisture, vermin or foreign material into the sleeping area.

In an embodiment, the cross of the "T"-shape can accommodate a pillow, if desired, and gives added protection and coverage to the head and shoulders of the user.

In use, a person can sleep with his or her torso in the main rectangular portion of the sleeping bag, either on the back or the stomach, and have their arms in any conceivable position or arrangement either inside or outside of the bag and still have comfort and protection provided by the cross of the "T" portion of the bag. The sleeping bag of the present invention can be used in any temperature or climate that the bag is rated for according to the standard rating system.

One embodiment is a sleeping bag with an improved design having additional material to accommodate the upper torso, arms and head of the user, having additional material removably attached to the main portion of the sleeping bag.

An alternative embodiment is a sleeping bag with an improved design having additional material to accommodate the upper torso, arms and head of the user, having the additional material removably attached using a zipper.

A further alternative embodiment is a sleeping bag with an improved design having additional material to accommodate the upper torso, arms and head of the user, having the additional material removably attached using hook and loop fastener.

A still further embodiment is a sleeping bag with an improved design having additional material to accommodate the upper torso, arms and head of the user, having the additional material removably attached using snaps.

A still further embodiment is a sleeping bag with an improved design having additional material to accommodate the upper torso, arms and head of the user, having the additional material removably attached using buttons.

A still further embodiment is a sleeping bag with an improved design having additional material to accommodate the upper torso, arms and head of the user, having the additional material as an integral part of and not removably attached to the main portion of the sleeping bag.

A still further embodiment is a sleeping bag with an improved design having additional material to accommodate the upper torso, arms and head of the user, having the additional material fixedly attached using stitching, sewing or glue, where material of cross of "T" is different material than main body of the sleeping bag.

A still further embodiment is a sleeping bag with an improved design having additional material to accommodate the upper torso, arms and head of the user, having the additional material fixedly attached using stitching, sewing or glue where material of cross of "T" is the same material as main body of the sleeping bag.

Materials suitable for use in the present invention include any material suitable for sleeping bags including, but not limited to: nylon GORE-TEX® expanded polytetrachloroethylene Fabric, fiberfill, hollofill, goose down, eider down, any down, PrimaLoft® brand ultra fine microfiber polyester insulation, canvas, poplin, TEK2® nylon shell fabric, Thinsulate™ microfiber insulation, cotton, cotton blends, polyester, polyester blends, taffeta, CLIMASHIELD™ continuous filament polyester insulation, high loft continuous filament synthetic insulation, polyester Enduralite® polyester shell fabric, polyester hollow core fiber, Polarguard® continuous filament polyester insulation synthetic polyester, for example.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A sleeping bag comprising a generally rectangular bottom layer and a generally rectangular top layer of the same size as the bottom layer, said top and bottom layers releasably attached to each other with a zipper at at least one of their coextensive sides, said top and bottom layers defining there between a main sleeping bag portion, said main sleeping bed portion sized to accommodate at least the legs and lower torso of a user, said bottom layer having separable fasteners attached at its top edge thereof, and a continuous, opening free, generally rectangular additional layer of material comprising separable fasteners attached to one of its edges, the separable fasteners on the bottom layer and additional layer adapted to cooperate with each other to releasably attach the additional layer of material to the top edge of the bottom layer to define a T-shaped lower layer, with the additional material defining a cross of the T-shape, the cross of the T-shape extending a substantial distance from the top and side edges of the bottom layer and being of a sufficient size to accommodate a pillow, the upper torso, the arms and the head of a user.

2. The improved sleeping bag of claim 1 wherein the additional material is removably attached to the bottom layer using hook and loop fasteners.

3. The improved sleeping bag of claim 1 wherein the additional material is removably attached to the bottom layer using a zipper.

4. The improved sleeping bag of claim 1 wherein the additional material is removably attached to the lower layer using buttons.

5. The improved sleeping bag of claim 1 wherein the additional material is made from the same material as the lower layer.

6. The improved sleeping bag of claim 1 wherein the additional material is different material than the lower layer.

* * * * *